US009463859B1

(12) United States Patent
Cooper, III et al.

(10) Patent No.: US 9,463,859 B1
(45) Date of Patent: Oct. 11, 2016

(54) ADAPTER PLATE, HEAT SHIELD, AND METHOD FOR THERMALLY ISOLATING A MOUNT COUPLED TO AN ADAPTER PLATE

(71) Applicant: Brunswick Corporation, Lake Forest, IL (US)

(72) Inventors: Robert D. Cooper, III, Fond du Lac, WI (US); Justin Martin, Saukville, WI (US); Donald Anderson, Jr., Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 44 days.

(21) Appl. No.: 14/621,992

(22) Filed: Feb. 13, 2015

(51) Int. Cl.
*B63H 20/32* (2006.01)
*B63H 20/00* (2006.01)

(52) U.S. Cl.
CPC ..... *B63H 20/32* (2013.01); *B63H 20/002* (2013.01)

(58) Field of Classification Search
CPC ..... B63H 20/32; B63H 20/002
USPC ..... 440/88–89
See application file for complete search history.

(56) References Cited

U.S. PATENT DOCUMENTS 5,487,687 A * 1/1996 Idzikowski ..... F02B 61/045 440/77
5,704,819 A * 1/1998 Isogawa ..... B63H 20/002 440/88 J
6,319,081 B1 * 11/2001 Davis ..... B63H 23/321 440/112
7,128,027 B1 * 10/2006 Straub ..... B63H 20/32 123/195 R
7,850,496 B1 * 12/2010 Eichinger ..... B63H 20/001 123/196 R
7,896,304 B1 * 3/2011 Eichinger ..... B63H 20/12 248/440
8,388,393 B1 * 3/2013 Eichinger ..... B63H 21/32 123/195 P
8,696,394 B1 * 4/2014 Langenfeld ..... F01M 11/0004 123/196 AB
8,820,701 B1 * 9/2014 Eichinger ..... B63H 20/06 248/610

FOREIGN PATENT DOCUMENTS

EP 0 751 044 A1 1/1997
EP 2 194 247 A2 6/2010

OTHER PUBLICATIONS

Eichinger et al., Midsection Housing for an Outboard Motor with Water-Cooled Mounts, Unpublished U.S. Appl. No. 14/591,493, filed Jan. 7, 2015.

* cited by examiner

*Primary Examiner* — Lars A Olson
*Assistant Examiner* — Jovon Hayes
(74) *Attorney, Agent, or Firm* — Andrus Intellectual Property Law, LLP

(57) ABSTRACT

An outboard motor adapter plate couples a marine engine to a driveshaft housing, and includes an upper rim configured to be coupled to a lower surface of a cylinder block of the engine. A lower rim of the adapter plate is configured to be coupled to an upper surface of a sump located in the driveshaft housing. A wall defines a passageway having an inner perimetral surface, and the inner perimetral surface extends from the upper rim to the lower rim. A mounting area is configured for coupling a mount to the adapter plate. A shield covers at least a portion of the inner perimetral surface adjacent the mounting area, so as to at least partially thermally isolate the mount from heated fluid that drains from the cylinder block, through the passageway, and into the sump. A method and a shield for thermal isolation are also described.

20 Claims, 8 Drawing Sheets

ADAPTER PLATE, HEAT SHIELD, AND METHOD FOR THERMALLY ISOLATING A MOUNT COUPLED TO AN ADAPTER PLATE

FIELD

The present disclosure relates to outboard motors, and more specifically to an adapter plate that couples a marine engine to a driveshaft housing.

BACKGROUND

U.S. Pat. No. 5,487,687, hereby incorporated herein by reference, discloses an outboard marine drive having a midsection between the upper power head and the lower gear case and having a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing complete and clean oil draining while the outboard drive is mounted on a boat and in the water wherein the operator can change oil without leaving the confines of the boat and entering the water.

U.S. Pat. No. 7,896,304, hereby incorporated herein by reference, discloses a support system for an outboard motor including mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to 90 degrees. The mounts are positioned in non-interfering relationship with the exhaust components of the outboard motor and its oil sump.

U.S. Pat. No. 8,820,701, hereby incorporated herein by reference, discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

Unpublished U.S. patent application Ser. No. 14/591,493, filed Jan. 7, 2015, hereby incorporated herein by reference, discloses a midsection housing for an outboard motor that includes a driveshaft housing having an oil sump provided therein. An adapter plate is coupled to a top of the driveshaft housing. The adapter plate has an inner surface along which oil from an engine mounted on the adapter plate drains into the oil sump. First and second pockets are formed in an outer surface of the adapter plate on first and second generally opposite sides thereof, the first and second pockets configured to receive first and second mounts therein. A water jacket is formed between the inner and outer surfaces of the adapter plate. The water jacket extends at least partway between the inner surface of the adapter plate and each of the first and second pockets, respectively. A method for cooling a mount is also provided.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, an outboard motor adapter plate for coupling a marine engine to a driveshaft housing includes an upper rim configured to be coupled to a lower surface of a cylinder block of the engine. A lower rim of the adapter plate is configured to be coupled to an upper surface of a sump located in the driveshaft housing. A wall defines a passageway having an inner perimetral surface, and the inner perimetral surface extends from the upper rim to the lower rim. A mounting area is configured for coupling a mount to the adapter plate. A shield covers at least a portion of the inner perimetral surface adjacent the mounting area, so as to at least partially thermally isolate the mount from heated fluid that drains from the cylinder block, through the passageway, and into the sump.

According to another example of the present disclosure, a method is for at least partially thermally isolating a mount coupled to an outboard motor adapter plate from heated fluid that drains from a marine engine cylinder block coupled to an upper rim of the adapter plate, through a passageway in the adapter plate, and into a sump coupled to a lower rim of the adapter plate. The method comprises locating a mounting area configured for coupling the mount to the adapter plate, and providing a shield that is configured to cover at least a portion of an inner perimetral surface of the passageway adjacent the mounting area so as to prevent the heated fluid from running over the inner perimetral surface adjacent the mounting area.

Another example of the present disclosure is of a shield for at least partially thermally isolating a mount coupled to an outboard motor adapter plate from heated oil that drains from a marine engine cylinder block coupled to an upper rim of the adapter plate, through a passageway in the adapter plate, and into an oil sump coupled to a lower rim of the adapter plate. The shield is configured to cover at least a portion of an inner perimetral surface of the passageway adjacent a mounting area configured for coupling the mount to the adapter plate.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
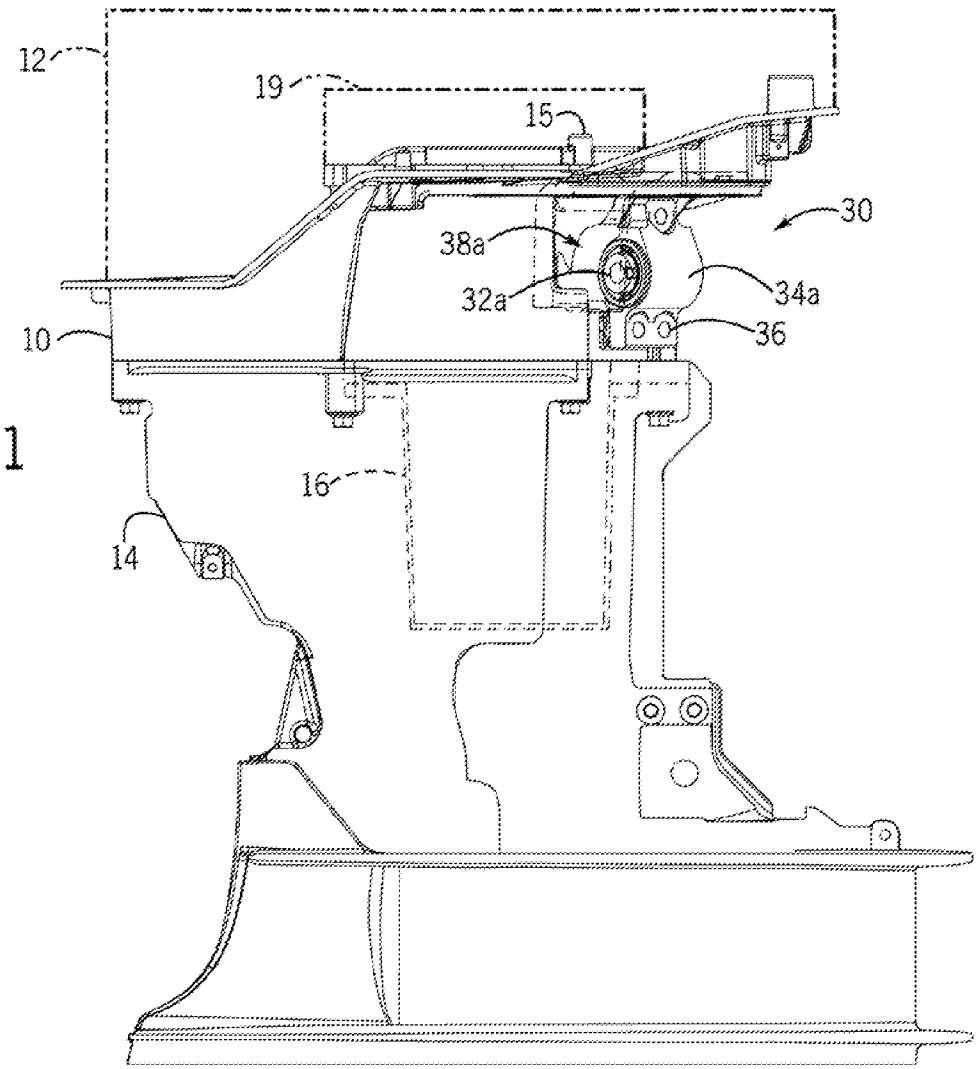
FIG. 1 illustrates a side view of an outboard motor adapter plate connected to a driveshaft housing.

FIG. 1 illustrates an outboard motor adapter plate 10 for coupling a marine engine, shown schematically at 12, to a driveshaft housing 14. As conventional, an upper end of a driveshaft 15 is coupled to a crankshaft (not shown) of the marine engine 12. The driveshaft 15 extends through the adapter plate 10 into the driveshaft housing 14, and thereafter couples at its lower end to a propeller shaft via a beveled gearset, all as is known in the art. A sump is shown schematically at 16, and is held beneath the adapter plate 10 so as to collect fluid that drains from the marine engine 12. This fluid, for example oil, has been provided to the marine engine 12 by an oil pump and is used to lubricate the moving parts of the engine 12 and to keep them cool while the engine is running. In other examples, the fluid provided to lubricate and/or cool the engine 12 may be automatic transmission fluid, water, or power steering fluid, depending on the engine and its internal parts. In this respect, the mention of the fluid as being "oil" throughout the specification, and reference to element 16 as being an "oil sump" is not meant to be limiting on the scope of the present claims.

Figure 2:
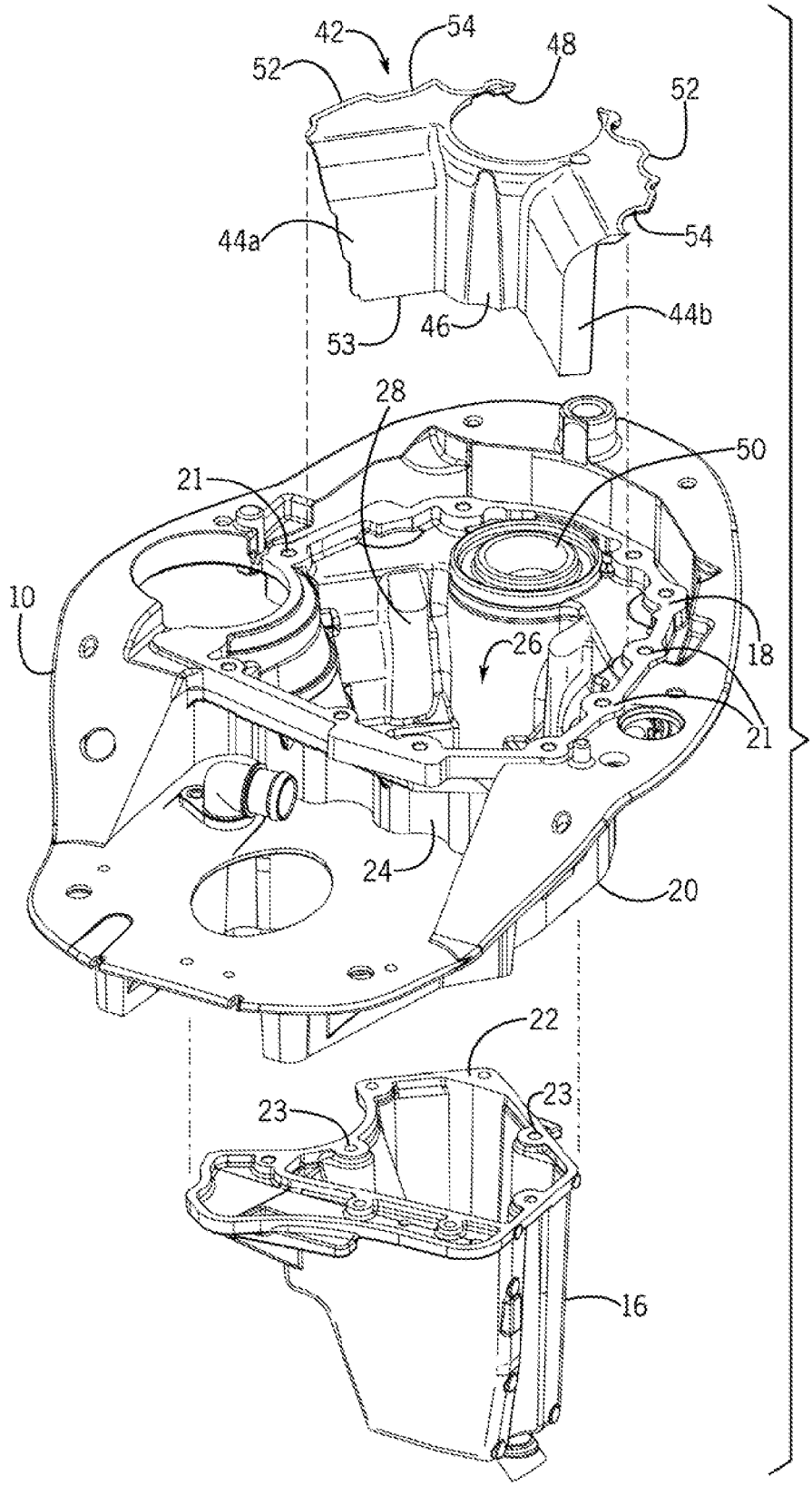
FIG. 2 illustrates an exploded view of the adapter plate, a heat shield, and a sump.

Referring to FIG. 2, the adapter plate 10 comprises an upper rim 18 configured to be coupled to a lower surface of a cylinder block 19 (shown schematically in FIG. 1) of the engine 12. This coupling can be accomplished by inserting a plurality of fasteners (not shown) through a plurality of holes 21 spaced around the rim 18, and into correspondingly spaced holes in the bottom of the cylinder block 19. A gasket may be provided between the upper rim 18 and the lower surface of the cylinder block 19. The adapter plate 10 also has a lower rim 20 configured to be coupled to an upper surface 22 of the oil sump 16 located in the driveshaft housing 14. Again, this may be done by inserting fasteners into holes 23 spaced around the upper surface 22 of the oil sump 16, and into correspondingly spaced holes in the lower rim 20. A gasket may also be provided between the lower rim 20 and the upper surface 22 of the oil sump 16. The adapter plate 10 also has a wall 24 defining a passageway 26 having an inner perimeteral surface 28. In the example shown, the inner perimeteral surface 28 extends from the upper rim 18 of the adapter plate 10 to the lower rim 20 of the adapter plate 10. The inner perimeteral surface 28 may extend around the entire inner perimeter of the wall 24, although only the foremost part of the inner perimeteral surface 28 is shown herein. Together, the coupling between the cylinder block 19 and upper rim 18, the inner perimetral surface 28 extending from the upper rim 18 to the lower rim 20, and the coupling between the lower rim 20 and the upper surface 22 of the oil sump 16 provide a fluid-tight pathway for drainage of oil from the engine 12, through the adapter plate 10, and into the oil sump 16. In any of the FIGS. 1-7, the adapter plate, oil sump, and driveshaft housing could instead be formed as one part, for example by using techniques such as lost foam molding or laser sintering. In this case, the lower "rim" 20 of the adapter plate 10 would be integral with the upper surface 22 of the oil sump 16.

Figure 3:
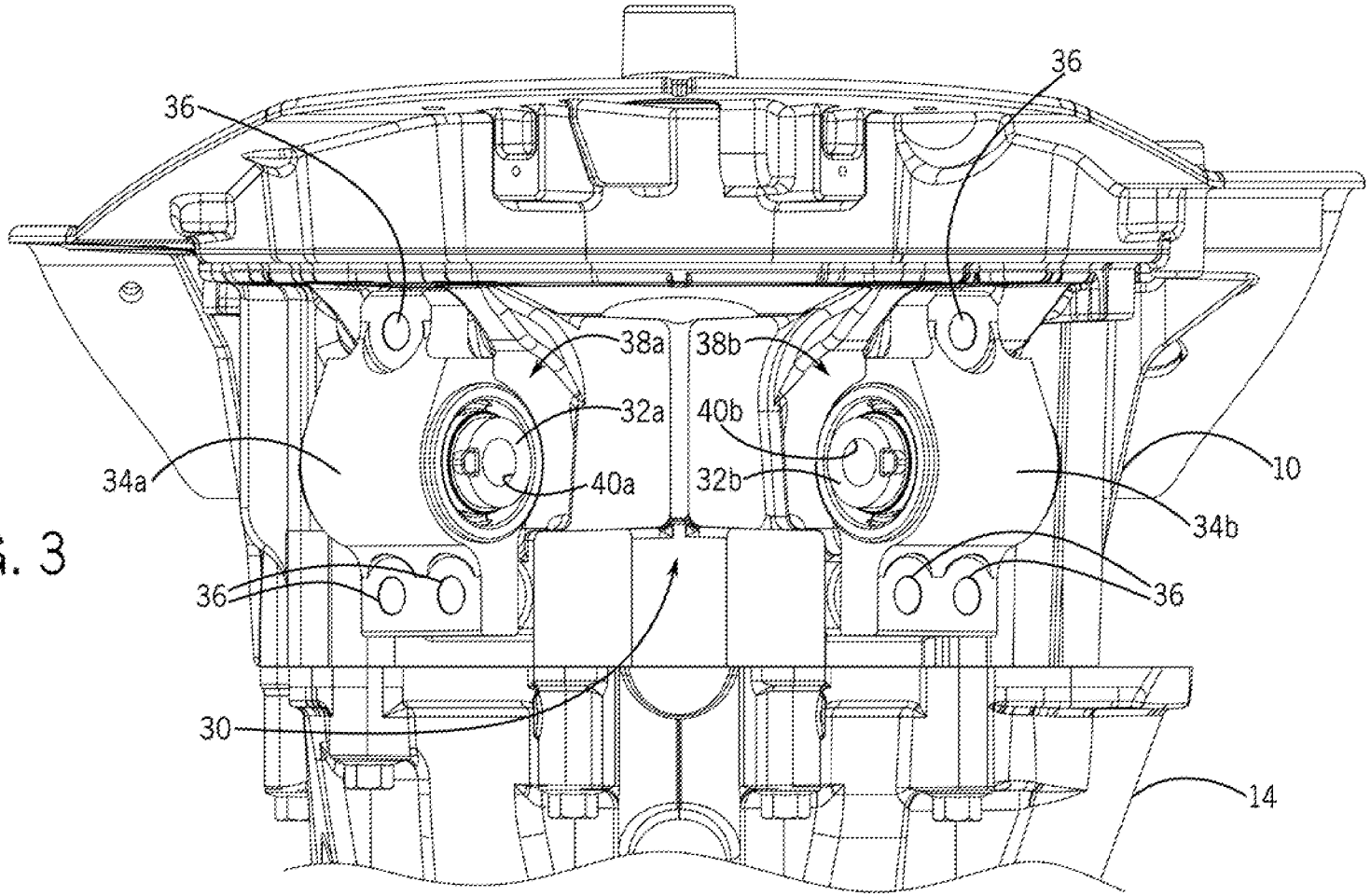
FIG. 3 illustrates a partial front view of the adapter plate and driveshaft housing.
Figure 4:
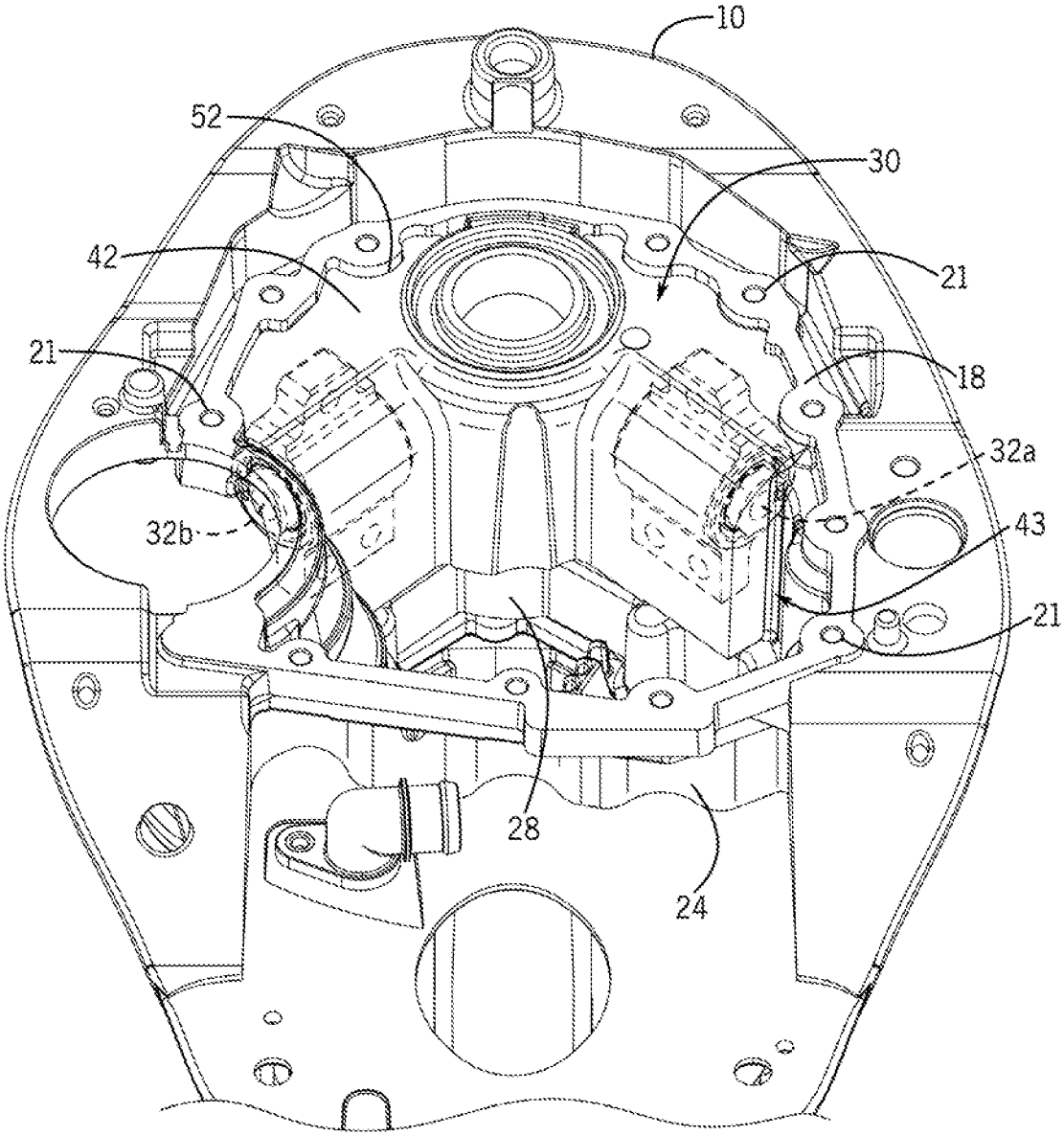
FIG. 4 illustrates a top perspective view of the adapter plate, with the heat shield in place.

Referring now to FIGS. 1 and 3, the adapter plate 10 further comprises a mounting area 30 that is configured for coupling a mount, such as mounts 32*a*, 32*b* to the adapter plate 10. In the example shown, depressions 38*a*, 38*b* are formed in an outer surface of the adapter plate 10. The depressions 38*a*, 38*b* are concave areas in the outer surface of the adapter plate 10 that at least partly define the mounting area 30. The mounts 32*a*, 32*b* are coupled to the adapter plate 10 adjacent the depressions 38*a*, 38*b*, which brings them in close proximity to the outer surface of the adapter plate 10. The mounts 32*a*, 32*b* are held to the adapter plate 10 by covers 34*a*, 34*b*. Fasteners (not shown) extend through holes 36 in each of the covers 34*a*, 34*b* to attach the mounts 32*a*, 32*b* to the adapter plate 10. As is known, a connector may extend through a hole 40*a*, 40*b* in each of the mounts 32*a*, 32*b*, respectively, and into an attachment bracket, which is coupled to a transom bracket, which is in turn coupled to a transom of a marine vessel. An example of this type of coupling to a marine vessel is shown in U.S. Pat. No. 8,820,701, which was incorporated by reference herein above, and will therefore not be described further herein. In one example, the mounts 32*a*, 32*b* may comprise an outer metallic shell surrounding an inner metallic shell and having an elastomeric spacer (or spacer made of other dampening material) between the inner and outer shells. One example of this type of mount is also described in the '701 patent. It should be understood, however, that the mounts 32*a*, 32*b* could take different forms and/or include parts other than shown herein or in the '701 patent.

Through research and development, the present inventors have realized that high mount temperatures contribute to thermal fatigue of the mount elastomer or dampening material, which degrades the engine mounts' performance over time. In prior art adapter plates, hot oil drains from the engine cylinder block 19 to the oil sump 16 directly over the inner perimetral surface 28 of the adapter plate 10. Because these prior art adapter plates are in direct or nearly direct thermal contact with the mounts 32*a*, 32*b*, the mounts become very hot. Current methods of cooling mounts bring water to or near the mounts; however, in some cases the addition of cooling passages that are either cast in or created by additional hoses are costly and not package friendly. With increasing space constraints required by today's consumers, outboard motor designers are increasingly asked to build a high-powered motor with a compact design. In an attempt to make outboard motors more compact, the mounts are moved closer to the adapter plate, for example by being placed in depressions 38*a*, 38*b* as shown in FIG. 3, or by being placed in pockets such as shown in the '701 patent. Consequently, the mounts are then closer to the hot, oil-wetted surfaces inside the adapter plate, where they encounter the higher temperatures that degrade their performance.

Through research and development, the present inventors have realized that oil or other fluid at a temperature of 260-300° F. in close proximity to the mounts 32*a*, 32*b* far exceeds temperatures that can be tolerated by the elastomeric spacer provided in the mount. The outer metallic shell of the mounts 32*a*, 32*b* and the aluminum of the adapter plate 10 do little to insulate the elastomeric spacer in the mount from heat. One example of an elastomer that can be used in the mounts is natural rubber, for which a temperature of 158° F. is preferred. If the rubber becomes marginally hotter than 150° F. it will volcanize or harden, and will therefore not be able to damp the vibrations of the outboard motor as well. These vibrations will therefore be transferred to the transom bracket and to the marine vessel. If the rubber becomes too hot, it will melt and will therefore not function at all. Additionally, when the rubber becomes too hot, its fatigue life can be decreased, and in some cases even halved. This means that over repeated use, mounts 32*a*, 32*b* that encounter hot temperatures will need to be replaced more often than mounts that are kept at lesser temperatures. Using an elastomer that is able to encounter and withstand higher temperatures is a possibility; however, high temperature elastomers sometimes have poor isolation and fatigue properties when compared to natural rubber. It should be understood that although natural rubber is one elastomer that can be used in the mounts 32*a*, 32*b* of the present disclosure, any other elastomer or dampening material could potentially be used in the mounts 32*a*, 32*b*, and the type of elastomer or dampening material used is not limiting on the scope of the present disclosure.

The inventors of the present disclosure have therefore invented a shield 42 (see FIGS. 2 and 4) that covers at least a portion of the inner perimeteral surface 28 adjacent the mounting area 30, so as to at least partially thermally isolate (and in some examples fully thermally isolate) the mounts 32*a*, 32*b* from heated oil or other fluid that drains from the cylinder block 19, through the passageway 26, and into the oil sump 16. The fact that the shield 42 covers at least a portion of the inner perimeteral surface 28 that is adjacent the mounting area 30 is illustrated by a dashed line showing of the mounts 32*a*, 32*b* in FIG. 4. It should be understood that the mounts 32*a*, 32*b* are actually not visible from the inner perspective view of the adapter plate 10 shown in FIG. 4; rather, the mounts 32*a*, 32*b* are located on the opposite (outer) side of the adapter plate 10, as shown in FIG. 3. However, the dashed line location of the mounts 32*a*, 32*b* is provided in order to show how the shield 42 is proximate the mounts in the mounting area 30.

As shown herein, the shield 42 is located radially inwardly of the inner perimeteral surface 28. This means that the heated oil from the cylinder block 19 drains over the shield 42, instead of directly over the inner perimetral surface 28 of the adapter plate 10. The shield 42 therefore prevents or limits the hot oil from contacting the inner perimeteral surface 28 of the wall 24 of the adapter plate 10, and therefore fully or partially thermally isolates the mounts 32*a*, 32*b* from the hot oil. In the example shown, the shape of the shield 42 generally mimics the shape of the inner perimeteral surface 28 of the passageway 26. For example, the shield 42 as depicted in FIG. 2 has two wings 44*a*, 44*b* and a central area 46 that connects the two wings 44*a*, 44*b*. The central area 46 has a semi-cylindrical opening 48 at its upper end, which partly surrounds a driveshaft passageway 50 in the adapter plate 10. The wings 44*a*, 44*b* extend from either side of the central area 46 at an angle from one another so as to follow the angled shape of the inner perimetral surface 28. The shield 42 is shown as one part, but could alternatively be several parts connected together in a fluid-tight manner.

In one example, there is an air gap 43 (FIG. 4) left between the inner perimeteral surface 28 and the foremost face of the shield 42 that faces the foremost portion of the inner perimetral surface 28. In other words, although the shape of the shield 42 generally mimics the shape of the inner perimeteral surface 28, it need not match it exactly, and can be offset from the inner perimetral surface 28 to allow for some air to pass between the two. This allows for cooling in this area, and also prevents transfer of heat from the shield 42 to the adapter plate 10. In another example, no air gap 43 is provided between the inner perimetral surface 28 and the shield 42. For example, the inner perimetral surface 28 could be dipped, coated, overmolded, or in other ways covered in an insulating material, which insulating material would constitute the shield 42, proximate the mounting area 30. Alternatively, the shield 42 could be separately molded to exactly fit against the geometry of the inner perimetral surface 28.

The shield 42 has a first edge 52 that is attached to the wall 24 of the adapter plate 10 proximate the upper rim 18. In one example, a liquid-tight seal 54 is provided between the first edge 52 and the upper rim 18 and/or the inner perimetral surface 28 proximate the upper rim 18. The liquid-tight seal 54 may be integrally formed with the first edge 52 of the shield 42. Alternatively, the seal 54 may comprise a strip of material that extends along the first edge 52 and that is applied after the shield 42 is formed. The seal 54 may also be applied as an epoxy or glue after the shield 42 has been placed appropriately in the adapter plate 10. The seal 54 can extend down the wings 44*a*, 44*b* of the shield 42 as well, although such extension is not shown herein, in order to illustrate the air gap 43. There is less likelihood that oil will come between the shield 42 and the inner perimeteral surface 28 of the adapter plate 10 in the area of the wings 44*a*, 44*b* than in the area of the first edge 52, where oil drains by gravity onto the shield 42 from the cylinder block 19. The seal 54 may also be located along the bottom edge 53 of the shield 42, although such seal is not shown herein, as there is also less likelihood that oil will come between the shield 42 and the inner perimetral surface 28 in this area as well.

The shield 42 can be made of many different types of materials. In one example, the shield 42 is made of metal and the air gap 43 between the shield and the inner perimeteral surface 28 provides the insulation between the heated oil running over the shield 42 and the mounts 32*a*, 32*b* in the mounting area 30. In another example, the shield 42 is made of a piece of wood with an epoxy coating or casing. In another example, the shield 42 is made of a polymer-based plastic, such as polyamide (nylon). Nylon provides good structural properties to the shield 42 and is also a good insulator that does not allow transfer of heat from the shield 42 to the adapter plate 10. Using a shield 42 allows the mounts 32*a*, 32*b* to be made with natural rubber instead of synthetic rubber, although as mentioned above, synthetic rubber could still be used, because the shield 42 acts as an oil deflector that creates a thermal barrier between the heated oil and the mounts 32*a*, 32*b*. The barrier slows and reduces the transfer of heat from the oil to the adapter plate 10 and/or oil sump 16 by preventing direct thermal contact between the hot engine oil and the adapter plate and/or oil sump. By diverting the oil, less heat is absorbed by the adapter plate and/or oil sump, which reduces the heat that is applied to the metal and elastomer of the mount, without the addition of passages or hoses for cooling water. The shield 42 is easily molded to different contours, which allows it to package easily in most engines without major modifications.

Just as the material of the shield 42 can vary, the material of the seal 54 between the shield 42 and the inner perimetral surface 28 and/or upper rim 18 can also vary. As mentioned above, the seal 54 could be a silicone strip. The seal 54 could alternatively be a piece of pliable rubber. An epoxy or glue could also serve as a seal that is applied after the shield 42 is put in place in the adapter plate 10. Any material that is at least initially flexible, compliable, or elastomeric would work as the seal 54. In one example, the seal 54 is made of a thermoplastic vulcanizate (TPV) in the thermoplastic elastomer (TPE) family, known as Santoprene™ and provided by ExxonMobil Chemical Company of Houston, Tex.

In the embodiment shown herein, the bottom edge 53 of the shield 42 extends approximately to the lower rim 20 of the adapter plate 10. In alternative embodiments, the bottom edge 53 of the shield 42 extends partway into the oil sump 16, to insulate the oil sump 16 from heat at its upper end. In the embodiment shown herein, the central area 46 and the wings 44*a*, 44*b* of the shield 42 extend over the foremost half of the inner perimetral surface 28. In other embodiments, the shield 42 extends around the entire inner perimetral surface 28 of the adapter plate 10, instead of being located only in an area proximate the mounting area 30.

Figure 5:
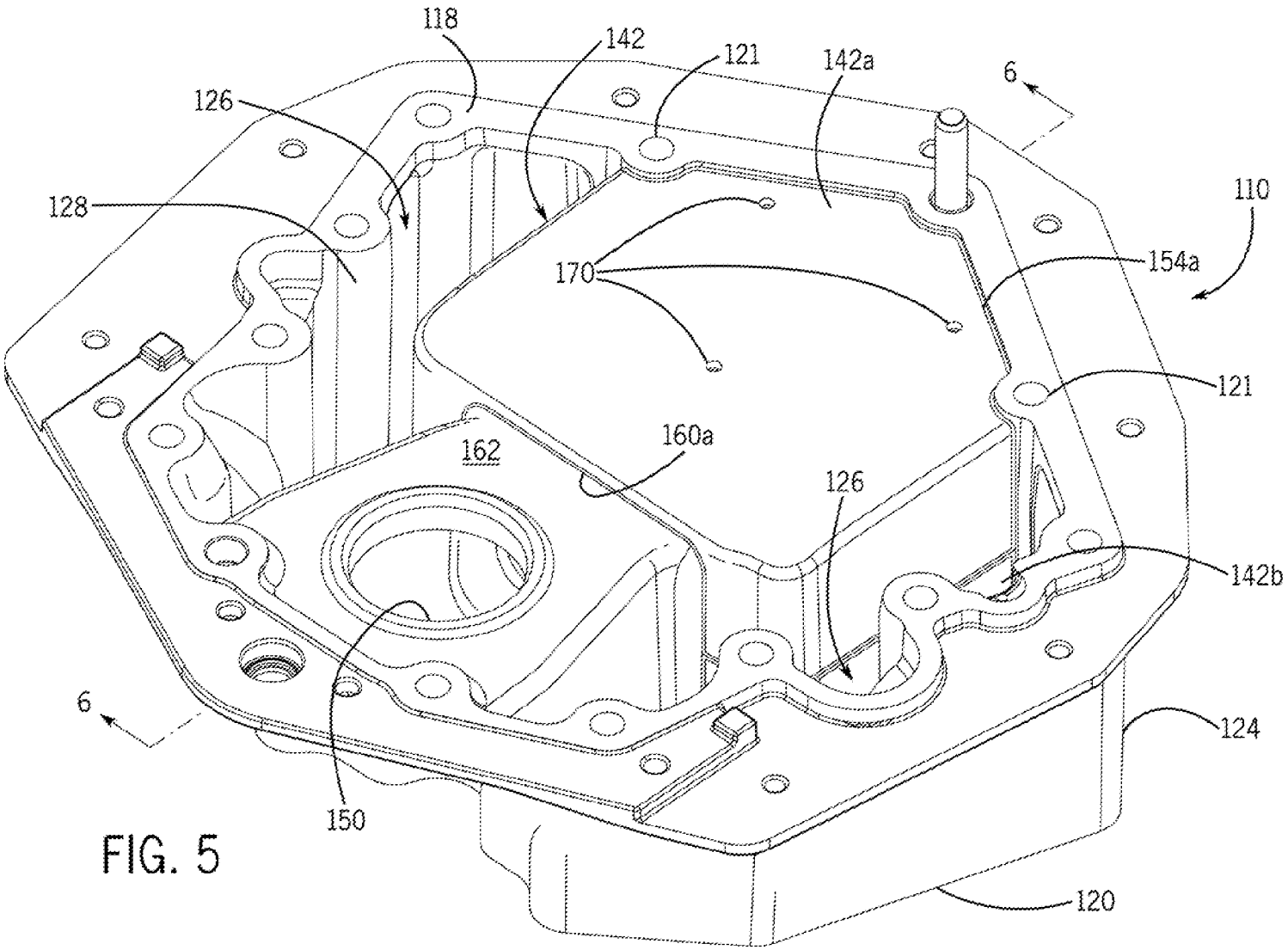
FIG. 5 illustrates another embodiment of an adapter plate and heat shield.
Figure 6:
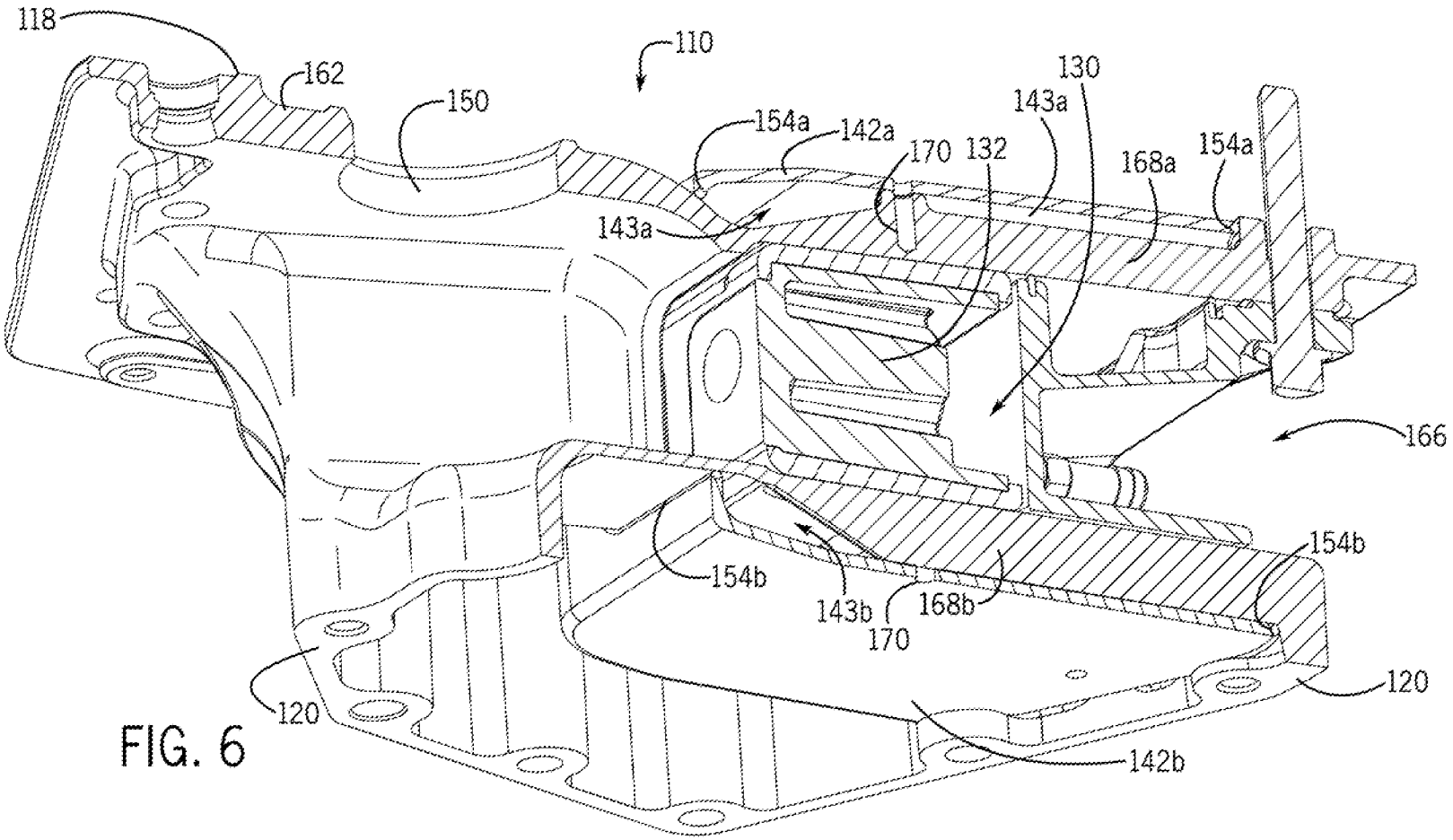
FIG. 6 illustrates a cross-sectional view taken along the line 6-6 in FIG. 5.
Figure 7:
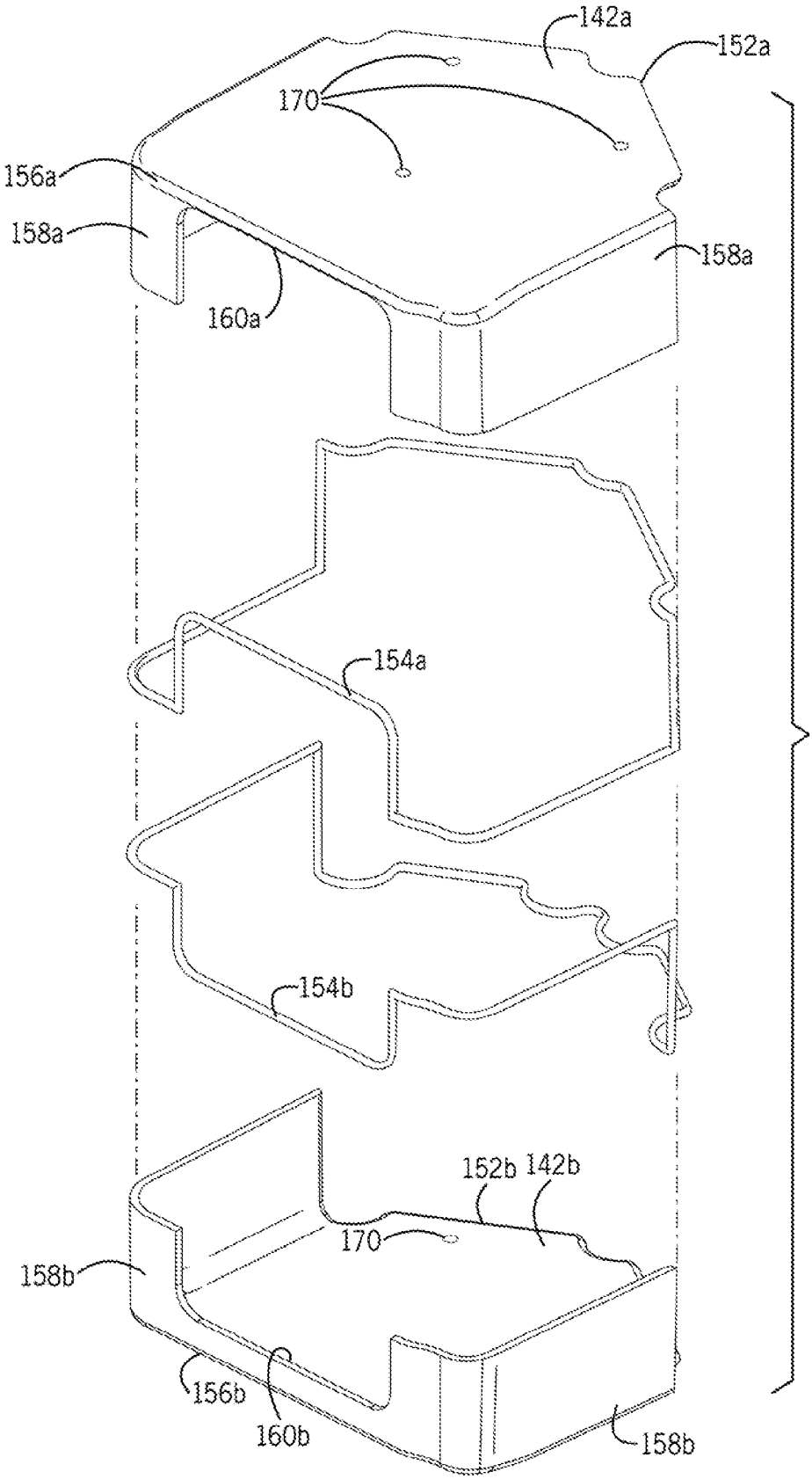
FIG. 7 illustrates an exploded view of the heat shield shown in the embodiment of FIGS. 5 and 6.

Now turning to FIGS. 5-7, a second embodiment of an adapter plate and associated shield will be described. The adapter plate 110 shown in these figures has an upper rim 118 for coupling to a cylinder block 19 of an engine 12, for example via fasteners inserted in holes 121. The adapter plate 110 also has a lower rim 120 for coupling to a driveshaft housing 14. Although the cylinder block 19 and driveshaft housing 14 are not shown in FIGS. 5-7, it should be understood that these parts are relatively similarly configured to those shown in FIG. 1. In the example of FIGS. 5-7, however, the driveshaft housing may have an integral oil sump, and oil from the cylinder block may drain through the adapter plate 110 and into the integral oil sump in the driveshaft housing. The adapter plate may also be integral with the oil sump and driveshaft housing, as mentioned herein above. Additionally, the driveshaft may not extend through the entirety of the driveshaft housing, in some examples.

The adapter plate 110 has a wall 124 including a passageway 126 having an inner perimeteral surface 128. A mounting area 130 is configured for coupling a mount 132 (or two mounts) to the adapter plate 110. The adapter plate 110 also has a shield 142, but in this instance the shield 142 comprises a first portion 142*a* and a second portion 142*b* that envelop the mounting area 130 therebetween. Seals 154*a*, 154*b* are provided between the first portion 142*a* and second portion 142*b* of the shield. In the example shown herein, the first and second portions 142*a*, 142*b* of the shield 142 are shown as an upper and a lower half. Alternatively, the first and second portions 142*a*, 142*b* could be provided as first and second lateral halves (i.e. a port portion and a starboard portion), or a lower main body and an upper lid (or vice versa). In still other examples, the shield 142 is made of one single part or more than two parts.

In this example, the first and second portions of the shield 142*a*, 142*b* envelop the mounting area 130, which comprises an alcove 166 in the outer surface of the adapter plate 110. The seal 154*a* seals a first edge 152*a* of the first portion of the shield 142*a* to the upper rim 118, or at least to a portion thereof. This first edge 152*a* is somewhat triangular, and is located at an aft end of the first portion 142*a* of the shield and the adapter plate 110. Toward the fore end of the first portion 142*a* of the shield, the first portion 142*a* of the shield forms a rectangular edge 156*a*. A downwardly extending skirt or wall 158*a* extends from the rectangular edge 156*a*. The wall 158*a* has a rectangular cutout 160*a* at the foremost portion of the first portion 142*a* of the shield. The second portion 142*b* of the shield has similar edges 152*b* and 156*b*, as well as similar wall 158*b* and cutout 160*b*. Together, the walls 158*a*, 158*b* and cutouts 160*a*, 160*b* seal around an outer surface of a casting 162 having a driveshaft passageway 150 extending therethrough at it foremost end. This casting 162 extends in the aft direction across the passageway 126 such that it forms the alcove 166 for the mounting area. Effectively, the casting 162 splits the passageway 126 in half, such that oil from the engine cylinder block 19 flows down on either side of the first portion 142*a* of the shield and of the casting 162. The first and second portions of the shield 142*a*, 142*b* can be attached to upper and lower halves 168*a*, 168*b* of the casting 162 by fasteners (not shown) that extend through a plurality of holes 170 in the upper and lower halves 168*a*, 168*b* of the casting 162. Alternatively, the shield portions 142*a*, 142*b* can be held in place via a tight fit with the seals 154*a*, 154*b*, or by a glue or epoxy-type seal. Air gaps 143*a*, 143*b* (FIG. 6) can be left between the first and second portions 142*a*, 142*b* of the shield and the upper and lower halves 168*a*, 168*b* of the casting 162. These air gaps 143*a*, 143*b* provide added thermal insulation between the oil-heated surface of the shield 142 and the mount 132.

In an alternative embodiment, only the first portion 142*a* of the shield is provided. This provides a thermal barrier between the mount 132 and oil that drains on top of the first portion 142*a* of the shield from the engine cylinder block 19. The second portion 142*b* of the shield can alternatively be provided to block the mount 132 from radiant heat that rises from the hot oil in the oil sump.

The materials of the shield 142 and seal 154*a*, 154*b* may be the same as those mentioned above with respect to the first embodiment.

The present disclosure therefore is of a shield 42, 142 for at least partially thermally isolating a mount 32, 132 coupled to an outboard motor adapter plate 10, 110 from heated fluid that drains from a marine engine cylinder block 19 coupled to an upper rim 18, 118 of the adapter plate 10, 110 through a passageway 26, 126 in the adapter plate, and into a sump 16 coupled to a lower rim 20, 120 of the adapter plate 10, 110. The shield 42, 142 is configured to cover at least a portion of an inner perimeteral surface 28, 128 of the passageway 26, 126 adjacent a mounting area 30, 130 configured for coupling the mount 32, 132 to the adapter plate 10, 110. In one example, the shield 42, 142 is shaped such that its shape generally mimics the shape of the inner perimeteral surface 28, 128 of the passageway 26, 126.

Figure 8:
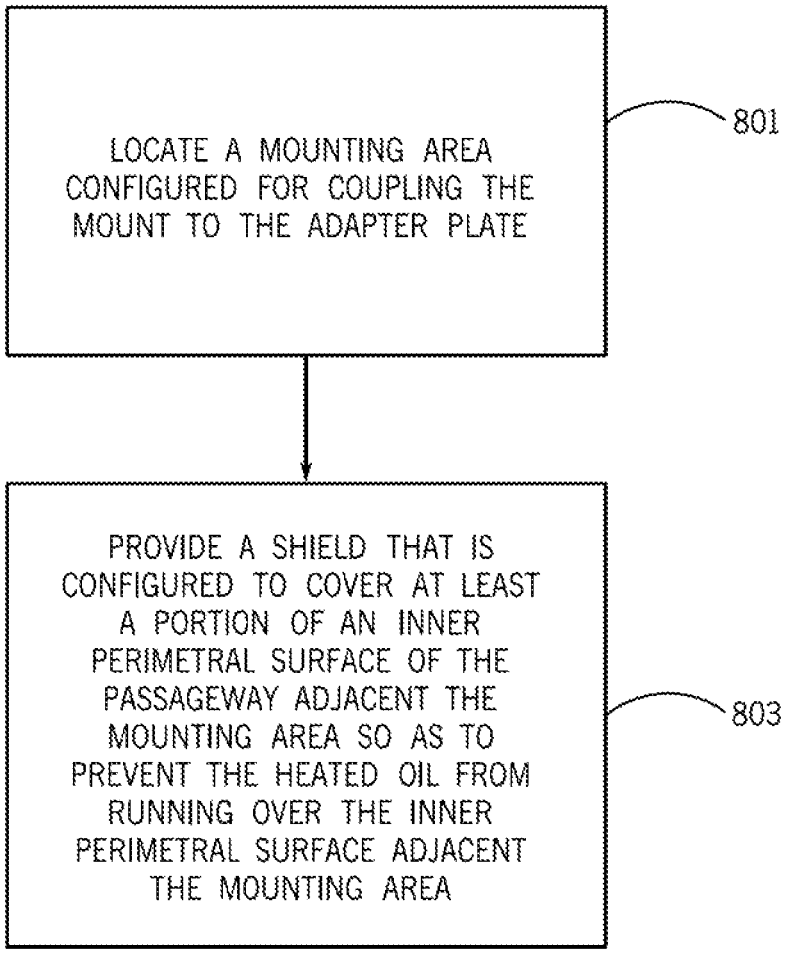
FIG. 8 illustrates one example of a method for thermally isolating a mount coupled to an outboard motor adapter plate according to the present disclosure.

Turning now to FIG. 8, a method for at least partially thermally isolating a mount 32, 132 coupled to an outboard motor adapter plate 10, 110 from heated fluid that drains from a marine engine cylinder block 19 coupled to an upper rim 18, 118 of the adapter plate through a passageway 26, 126 in the adapter plate, and into a sump 16 coupled to a lower rim 20, 120 of the adapter plate will be described. The method comprises, with reference to box 801, locating a mounting area 30, 130 configured for coupling the mount 32, 132 to the adapter plate 10, 110. As shown in box 803, the method comprises providing a shield 42, 142*a*, 142*b* that is configured to cover at least a portion of an inner perimetral surface 28, 128 of the passageway adjacent the mounting area 30, 130 so as to prevent the heated fluid from running over the inner perimeteral surface adjacent the mounting area.

The method may further comprise placing the shield 42, 142 radially inwardly of the inner perimetral surface 28, 128. The method may further comprise forming the shield 42, 142 such that its shape generally mimics the shape of the inner perimeteral surface of the passageway. An air gap 43, 143*a*, 143*b* may be provided between the inner perimetral surface 28, 128 and the shield. The shield may be formed of polyamide plastic. A liquid-tight seal 54, 154*a*, 154*b* between an edge 52, 152*a*, 152*b* of the shield and upper rim 18, 118 of the adapter plate may be provided. The liquid-tight seal may be formed integrally with the edge of the shield. The shield may alternatively be formed as a first portion 142*a* and a second portion 142*b* that are configured to envelop the mounting area 130 therebetween.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An outboard motor adapter plate for coupling a marine engine to a driveshaft housing, the adapter plate comprising:

an upper rim configured to be coupled to a lower surface of a cylinder block of the engine;

a lower rim configured to be coupled to an upper surface of a sump located in the driveshaft housing;

a wall defining a passageway having an inner perimetral surface, the inner perimetral surface extending from the upper rim to the lower rim;

a mounting area configured for coupling a mount to the adapter plate; and a shield that covers at least a portion of the inner perimetral surface adjacent the mounting area, so as to at least partially thermally isolate the mount from heated fluid that drains from the cylinder block, through the passageway, and into the sump.

2. The adapter plate of claim 1, wherein the shield is located radially inwardly of the inner perimetral surface.

3. The adapter plate of claim 2, wherein the shape of the shield generally mimics the shape of the inner perimetral surface of the passageway.

4. The adapter plate of claim 3, further comprising an air gap between the inner perimetral surface and the shield.

5. The adapter plate of claim 1, wherein the shield has an edge that is attached to the wall proximate the upper rim.

6. The adapter plate of claim 5, further comprising a liquid-tight seal between the edge and the upper rim.

7. The adapter plate of claim 6, wherein the seal comprises a strip of thermoplastic vulcanizate that extends along the first edge.

8. The adapter plate of claim 1, wherein the shield is made of polyamide plastic.

9. The adapter plate of claim 1, further comprising a depression in an outer surface of the adapter plate that at least partly defines the mounting area, wherein the mount is coupled to the adapter plate adjacent the depression.

10. The adapter plate of claim 1, wherein the shield comprises a first portion and a second portion that envelop the mounting area therebetween.

11. A method for at least partially thermally isolating a mount coupled to an outboard motor adapter plate from heated fluid that drains from a marine engine cylinder block coupled to an upper rim of the adapter plate, through a passageway in the adapter plate, and into a sump coupled to a lower rim of the adapter plate, the method comprising:

locating a mounting area configured for coupling the mount to the adapter plate; and providing a shield that is configured to cover at least a portion of an inner perimetral surface of the passageway adjacent the mounting area so as to prevent the heated fluid from running over the inner perimetral surface adjacent the mounting area.

12. The method of claim 11, further comprising placing the shield radially inwardly of the inner perimetral surface.

13. The method of claim 12, further comprising forming the shield such that its shape generally mimics the shape of the inner perimetral surface of the passageway.

14. The method of claim 13, further comprising providing an air gap between the inner perimetral surface and the shield.

15. The method of claim 13, further comprising forming the shield of polyamide plastic.

16. The method of claim 11, further comprising providing a liquid-tight seal between an edge of the shield and the upper rim of the adapter plate.

17. The method of claim 16, further comprising forming the liquid-tight seal integrally with the edge of the shield.

18. The method of claim 11, further comprising forming the shield as a first portion and a second portion that are configured to envelop the mounting area therebetween.

19. A shield for at least partially thermally isolating a mount coupled to an outboard motor adapter plate from heated fluid that drains from a marine engine cylinder block coupled to an upper rim of the adapter plate, through a passageway in the adapter plate, and into a sump coupled to a lower rim of the adapter plate, the shield being configured to cover at least a portion of an inner perimetral surface of the passageway adjacent a mounting area configured for coupling the mount to the adapter plate.

20. The shield of claim 19, wherein the shield is shaped such that its shape generally mimics the shape of the inner perimetral surface of the passageway.

* * * * *